US006175291B1

(12) United States Patent
Kleinert et al.

(10) Patent No.: US 6,175,291 B1
(45) Date of Patent: Jan. 16, 2001

(54) ELECTROMAGNET

(75) Inventors: Dieter Kleinert, Memmingen; Georg Scherer, Kirchheim; Helmut Mang, Memmingen; Reinhard Häring, Lauben; Manfred Hanka, Woringen, all of (DE)

(73) Assignee: Dipl- Ing. Wolfgang E. Schultz, Memmingen (DE)

( * ) Notice: Under 35 U.S.C. 154(b), the term of this patent shall be extended for 0 days.

(21) Appl. No.: 09/236,613

(22) Filed: Jan. 26, 1999

(51) Int. Cl.[7] ..... H01F 3/00

(52) U.S. Cl. ..... 335/251; 335/255

(58) Field of Search ..... 335/228, 220, 335/251, 255; 251/129.15

(56) References Cited

U.S. PATENT DOCUMENTS

| | | | | |
|---|---|---|---|---|
| 3,735,302 | * | 5/1973 | Eckert | 335/262 |
| 4,751,487 | * | 6/1988 | Green, Jr. | 335/234 |
| 4,823,842 | * | 4/1989 | Toliusis | 137/626.65 |
| 5,010,911 | * | 4/1991 | Grant | 137/68.1 |
| 5,080,323 | * | 1/1992 | Kreuter | 251/129.1 |
| 5,417,403 | * | 5/1995 | Shurman et al. | 251/129.16 |

* cited by examiner

*Primary Examiner*—Lincoln Donovan
*Assistant Examiner*—Tuyen T. Nguyen
(74) *Attorney, Agent, or Firm*—Jacobson, Price, Holman & Stern, PLLC

(57) ABSTRACT

A magnet coil which receives an armature movable longitudinally with respect to the coil axis and having an armature rod. A support of the armature or of the armature rod in a core serves also for the guidance of the magnetic field, a direct support of the armature or of the armature rod on a surface of the core.

9 Claims, 4 Drawing Sheets

Prior Art

ELECTROMAGNET

BACKGROUND TO THE INVENTION

The invention relates to an electromagnet, comprising a magnet coil which receives an armature movable longitudinally with respect to the coil axis and having an armature rod, and comprising a support of the armature or of the armature rod in a core serving also for the guidance of the magnetic field.

Electromagnets have a wide range of application, for example, as actuating or pressure-regulating magnets. In particular, such magnets are employed, for example, in automatic transmissions of vehicles. Owing to the operating conditions which exist there, in particular in an oil sump, the presence of a high degree of fouling and great temperature differences, the above-described electromagnets are subject to exacting requirements.

The above-described electromagnets are usually constructed in such a way that one or more slide bearings are provided, in particular in the core material of the electromagnet, in order to support and guide the movable element of the electromagnet, namely the armature or the armature rod. As a rule, the bearing is an axial slide bearing which takes up the forces occurring parallel to the coil axis or to longitudinal extent of the rod. These slide bearings or slide-bearing bushes involve a relatively high outlay in respect of mounting. The region which receives the armatures or the armature rod must have a corresponding receiving bore for the slide-bearing bush. For the fitting of the bearing a tolerance must be provided which must be precisely designed in accordance with the bearing quality. This results in a corresponding outlay in respect of the fitting of the bearing.

Since a plurality of slide rings (=as bearings) are also provided for the support of the armature rod, the various bearings must be mounted in an aligned manner. Since a misalignment or radial run-out cannot be ruled out in this case, this also leads to a further tolerance. Since the above-described electromagnets may be employed in areas subject to high temperature fluctuations, these temperature fluctuations must also be taken into account with a corresponding bearing play.

As a result, owing to air-gap losses and frictional hysteresis, the efficiencies of the magnets are relatively poor. Owing to the large bearing play, there is also a susceptibility to fouling and the increased risk of the fouling leading to disruption of the operation of the electromagnet. Moreover, the relatively low precision owing to the large bearing play is also responsible for a relatively poor magnetic circuit, since the bearing plays also lead to relatively large losses at the air gaps which cannot be compensated for. Furthermore, the fitting of the slide-bearing bushes involves a relatively high outlay, since, as described, these bushes require a precise receiving bore. Additional outlay is involved in avoiding an axial displacement of the bearings through the fitting of suitable securing means. Lastly, the fitting of the bearings also takes up additional installation space.

Since the reliability of the above-described electromagnet depends on the accuracy of the support, it is necessary specifically to monitor the support, with corresponding outlay in terms of production and inspection, in order to achieve a satisfactory quality.

BRIEF SUMMARY OF THE INVENTION

The present invention has the object of developing an electromagnet such that the latter can be produced with higher precision and thus a higher quality, at low manufacturing costs.

This invention is achieved by an electromagnet as described at the outset, i.e., an electromagnet comprising a magnet coil which receives an armature movable longitudinally with respect to the coil axis and having an armature rod, and comprising a support for the armature or armature rod in a core serving also for the guidance of the magnetic field. According to the invention direct support of the armature and/or of the armature rod on a surface of the core is provided. The direct support of the armature means that the fitting of the bearing bushes is dispensed with. This gives rise to an immediate advantage in terms of manufacture. Since no bearings are used any more, misalignment or radial run-out is minimized. The outlay in respect of adjustment or calibration of the position, or axial securing against undesired slipping of the bearing bushes, is no longer necessary either.

In a preferred configuration of the invention, there is provision for a bore, preferably a precision bore, to be provided in the core, on the inner surface of which core the armature or the armature rod is supported, in particular without a separate bearing, and the rod assumes the supporting function. The use of the precision bore is retained from the known electromagnet. This precision bore was necessary anyway to achieve an appropriate quality of the orientation of the bearing after the fitting of the bush. Since the use of an additional bearing is deliberately dispensed with, the supporting function is assigned to the rod. Besides supporting the armature rod in a bore, however, it is also possible to support the armature on a surface, of any nature whatsoever, of the core, or to guide it on this surface.

In a preferred configuration of the invention, it is proposed that the armature rod is made of a nonmagnetic bearing material. By using a nonmagnetic bearing material as the material for the armature rod, the magnetic properties of the magnet are not impaired. In particular, the magnetic field lines guided in the core are not deflected by such a configuration, which ultimately could lead to an impairment of the efficiency of the device.

There is provision for the armature to comprise a plurality of elements—the armature body and the armature rod. According to the invention, elements of the armature assume the direct support on a surface of the core. Besides the use of the armature rod, however, it is also possible to support the armature body correspondingly in a core element. Such a configuration allows, for example, a double support of the armature by means of the armature body and the armature rod to be provided. In order to achieve as high an efficiency as possible, there is provision to form the armature body from a ferromagnetic material. The armature in this case comprises a plurality of elements consisting of different materials which are appropriately welded, adhesively bonded or caulked, or connected in some other way, to one another.

Besides the configuration in which one armature rod is arranged on the armature body, however, it is also possible to arrange two armature rods. The support of the armature may in this case be provided either via the two armature rods or via the armature body alone, in which case the armature rods merely assume controlling functions.

It has been found here that the surface, which slides on the surface of the core, of the armature or of the armature rod is harder than the surface of the core. It has been found here that the surface of the armature/the armature rod is from 2× to 10×, but preferably from 3× to 5× harder than the stationary sliding surface of the core. In order to establish an appropriate ratio of hardnesses, recourse may be had to the methods for hardening the surfaces known in the prior art.

The preferred materials employed here are brass or known bronze alloys or other known bearing metals, such as lead bronzes, tin bronzes, aluminium bronzes or copper, lead, zinc, tin with appropriate added alloys of other materials, such as lead, copper, antimony, aluminium, zinc. The compositions of these alloys are known from the prior art. Appropriate choice of the alloy makes it possible to optimize the armature rod also with regard to the temperature range employed.

The advantages of the configuration according to the invention reside in the markedly reduced manufacturing outlay in respect of these electromagnets. At the same time, the precision of the rod guidance is increased, thereby also resulting in air-gap conditions of greater definition and precision. The magnetic air-gap losses can be minimized, thereby bringing about a better magnetic circuit, which ultimately leads to a higher efficiency. The smaller bearing gaps result in lower susceptibility to fouling. Since no bearings, requiring appropriate alignment relative to one another, are provided any more, improved concentric running properties as well as a low frictional hysteresis are achieved, thereby also markedly improving the mechanical loading and ultimately also the efficiency of the electromagnet. The invention leads to a more compact and lower-cost design, with regard to which the manufacture is also markedly simplified through the elimination of several steps, namely the fitting, adjustment and securing of the bearing bush. At the same time, a more precise device is created which better utilizes the power input and achieves a higher efficiency.

DETAILED DESCRIPTION OF PREFERRED EMBODIMENTS

Figure 4:
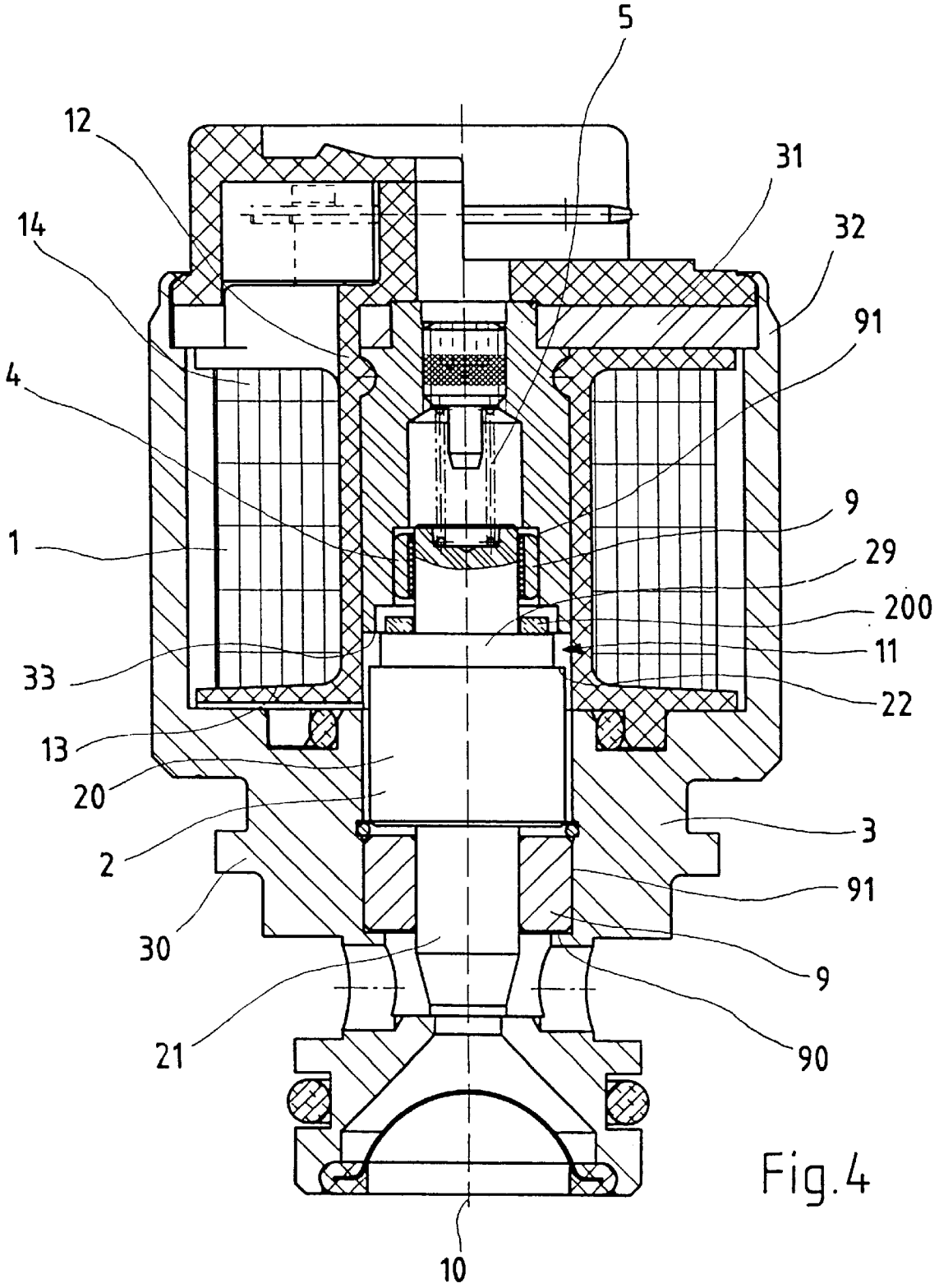
FIG. 4 is a vertical section through a prior art electromagnet.

Referring first to FIG. 4, there is shown an electromagnet according to the prior art. The basic structure of this electromagnet and the electromagnet according to the invention is essentially the same. Thus, like reference numerals are used, and the description can also be read as being applicable to the invention.

The electromagnet has a magnet coil 1. This magnet coil 1 generates a magnetic field when supplied with current. The magnetic field runs in the interior of the coil substantially parallel to the coil axis 10, the magnetic field lines being closed. To improve the guidance of the magnetic field lines, the core 3 is provided.

The magnet coil 1 is composed of a coil body 12, made for example of plastic, and has flanges 13 at the ends. The flanges 13 serve to guide the coil wire 14 wound up on the coil body 12.

The core 3 comprises a plurality of elements 30, 31. For assembly, the two core parts 30, 31—the core upper part 31 and the core lower part 30—are caulked, adhesively bonded, welded or otherwise connected to one another at their junction 32. The core 3 not only surrounds the outer region of the coil, but at the same time also penetrates into the interior of the coil. Besides the guidance of the magnetic field, the core 3 also has a mechanical guiding function for the armature 2. Other elements, such as for example a restoring spring 5, which pushes the armature 2 back into the initial position again when no magnetic field is present, are also supported on the core 3.

The armature 2 illustrated in FIG. 4 comprises a plurality of elements. The armature rod 21 is guided in the bearing 9. Situated thereabove with a greater diameter is the armature body 20, which with its effective surface 22 delimits the air gap 11 with respect to the core 3.

Arranged above the armature body 20 is the prearmature 29, which has a smaller diameter than the armature body 20 but still a greater diameter than the armature rod 21.

Situated on the prearmature 29 is an antisticking disc 200, which prevents the armature 2 and the core 3 from sticking together.

It is precisely the stepping of the core 3 for the purpose of receiving the prearmature 29 and the armature body 20 that is important for the guidance of the magnetic flux.

It should be pointed out that the parts which in FIG. 4 are not explicitly connected with the support 4 of the armature rod are of course also usable in constructing the invention and are included in the scope of protection.

The core 3 is preferably made of magnetizable material, for example iron or some other ferromagnet or other materials.

The armature 2 is arranged in a movably mounted manner in the interior of the magnet coil 1. The armature 2 in this case comprises a plurality of elements, namely the armature body 20 and the armature rod 21. The armature rod 21 may extend in this case on only one side or on both sides of the armature body 20. The armature rod 21 is arranged here coaxially with the coil axis 10.

In the electromagnet according to FIG. 4, the air gap 11 is situated in the upper half of the magnet coil between the upper surface 22 of the armature body 20 and the lower delimiting surface 33 of the core part 31.

For guidance of the armature 2, in particular of the armature rod 21, a support 4 is provided.

In the prior art (configuration according to FIG. 4), bearings 9 which arc mounted in the core 3 in the upper and lower region, both in the interior of the magnet coil 1 and outside the magnet coil 1, and support the armature rod 21 are provided for this purpose. In this case, the bearing bush 9 is let in and fitted in in a corresponding bore 91 of the core 3. This bore 91 has an appropriate grade which is higher than the grade of the bearing 9, in order to achieve a sufficient accuracy of the support. FIG. 4 illustrates the armature rod 21 arranged both below and above the armature body 20 and supported in each case in separate bearings 9. The bearings employed in the prior art are sintered aluminium bearings, brass bearings or plastic composite bearings. In order to secure the bearings 9 against axial slipping, the core 3 has a flange-like caulking 90 as securing means. In contrast to the bearings 9, the armature rod 21 in the example according to the prior art is made of relatively hard material. With regard to the prior art, the supporting function was thus clearly fulfilled by the separate bearing 9, which, being a separate component, involves additional outlay in respect of fitting.

It is clear that the fitting of the bearings 9 involves an additional outlay. The configuration of the invention according to the embodiments of FIGS. 1 to 3 dispenses with the use of bearings 9.

Figure 1:
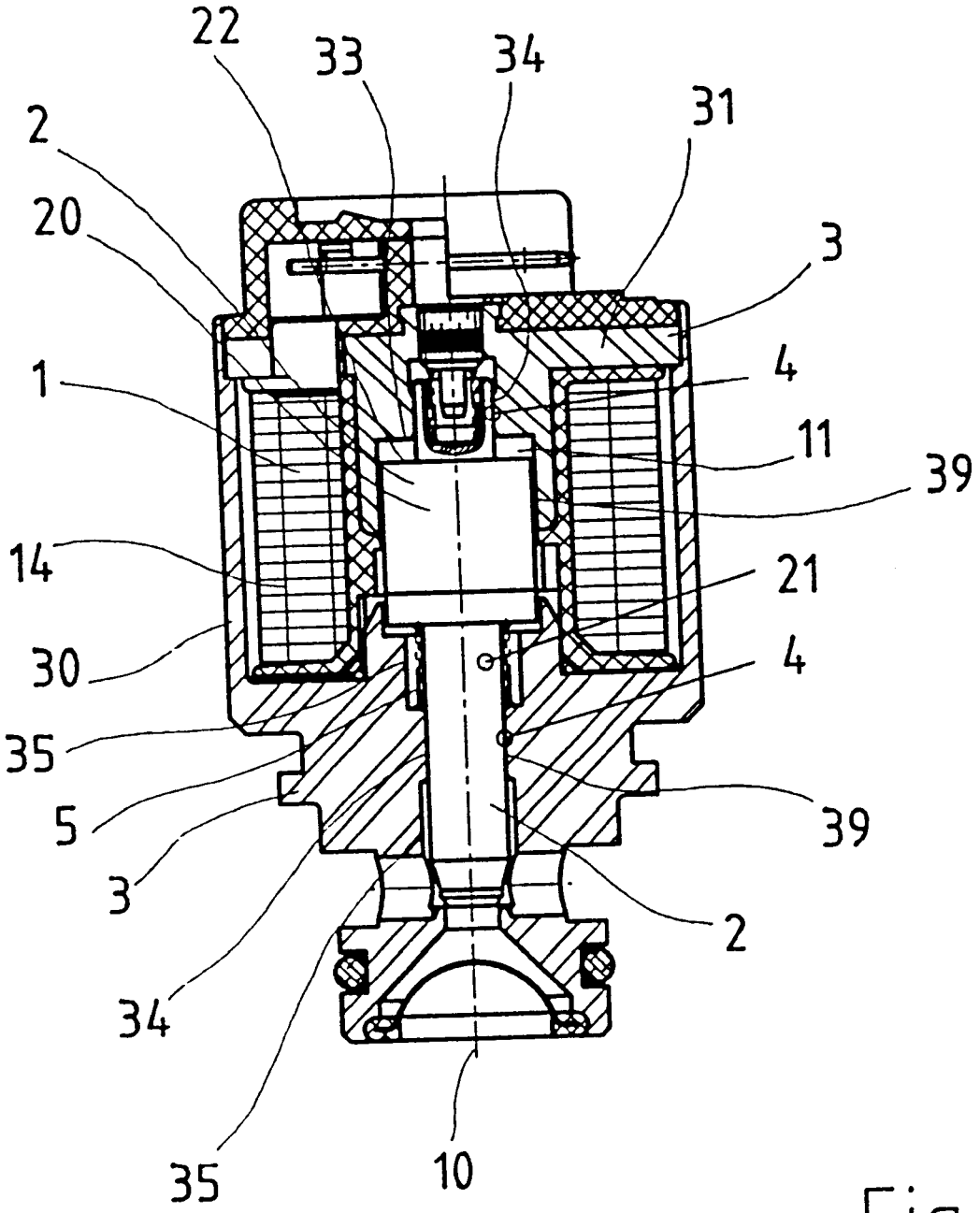
FIG. 1 is a vertical section of a first embodiment of an electromagnet according to the invention.
Figure 2:
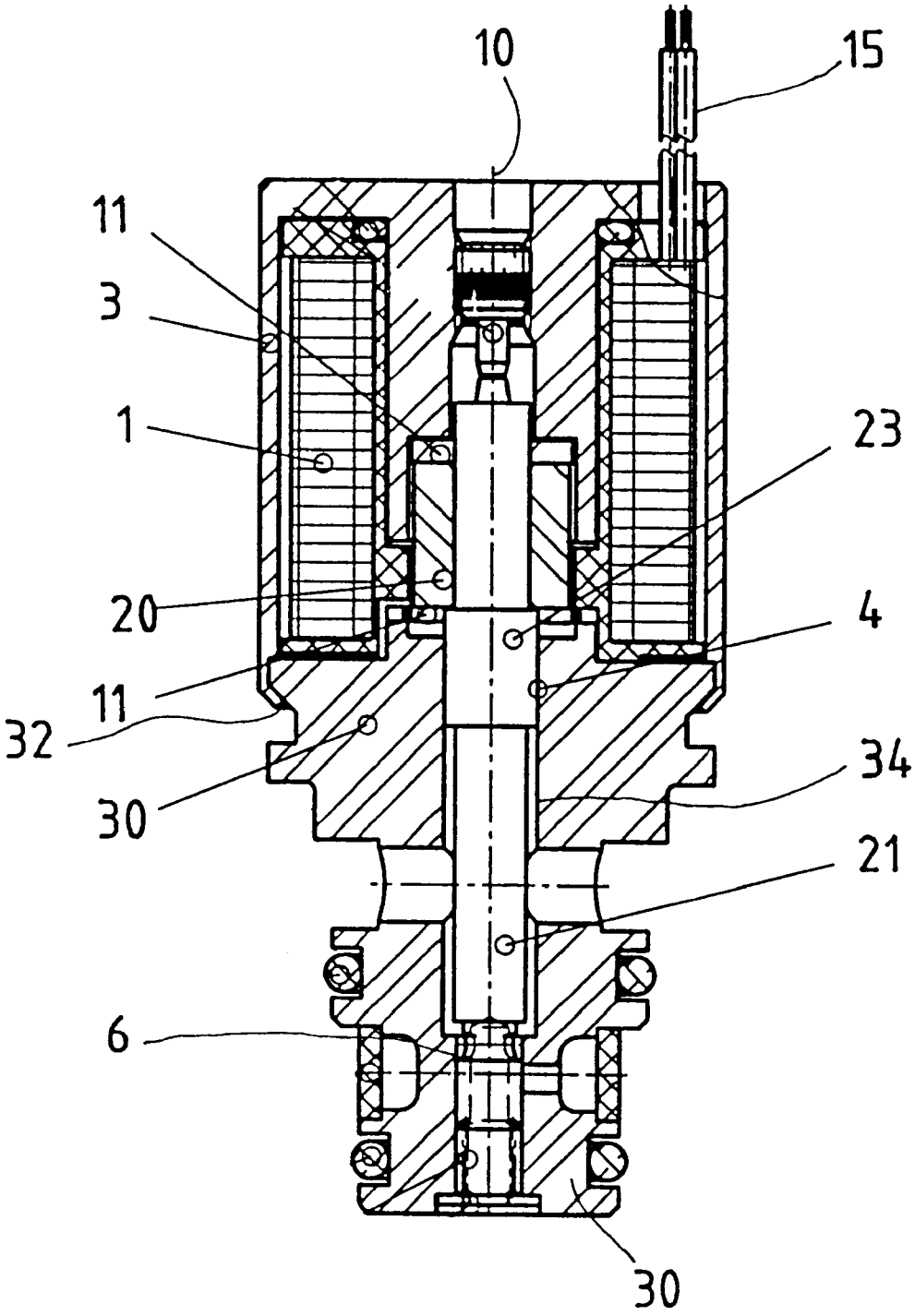
FIG. 2 is a view similar to FIG. 1 of a second embodiment of an electromagnet according to the invention.
Figure 3:
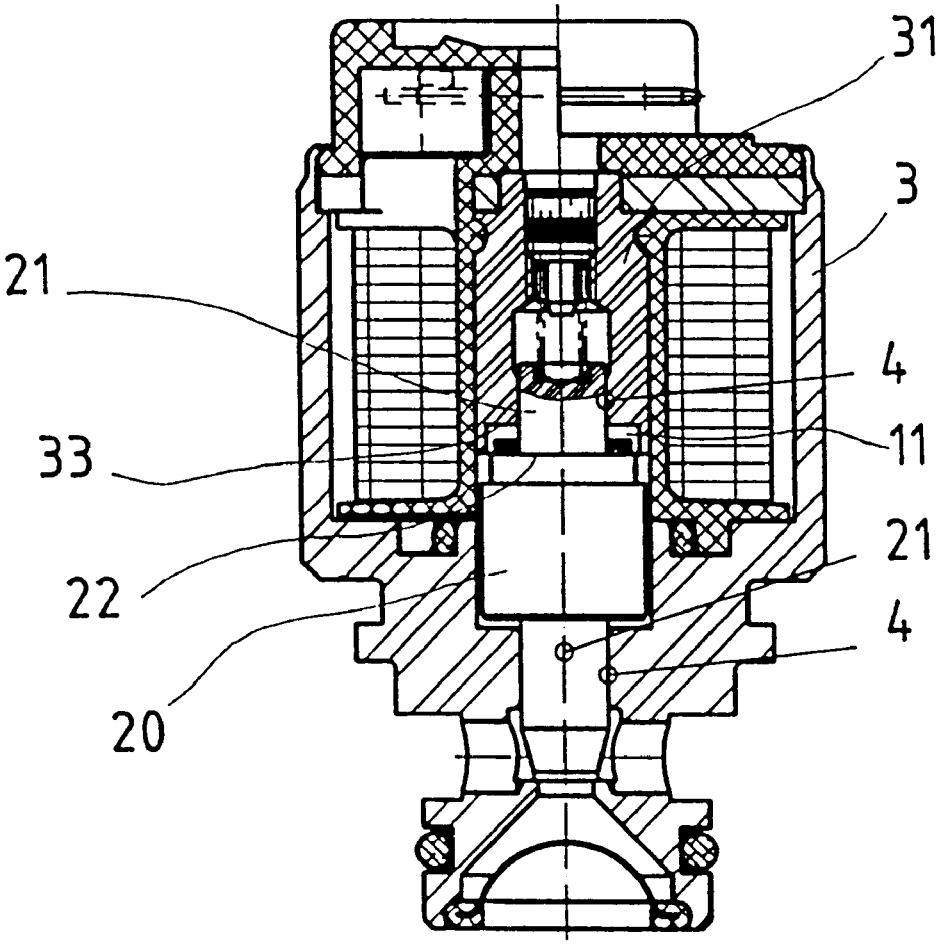
FIG. 3 is a view similar to FIG. 1 of a third embodiment of an electromagnet according to the invention.

The structure of the electromagnets of FIGS. 1 to 3 similar to the structure as described with regard to FIG. 4. Detailed repetition of the same elements is therefore dispensed with.

The difference from the configuration of the prior art is in the support 4. The electromagnet according to FIG. 1 again has, on both sides of the armature body 20, in each case an armature rod 21 supported in the respective core parts 3, 30, 31. In this case, the armature rod 21 or the armature 2 is supported directly on the surface of the core 3, 30, 31. To this end, the core parts 3, 30, 31 have precision bores 34 which have the same grade as the bores 91 in FIG. 4, which serve to receive the bearings 9. Since, however, no bearings are fitted any more, there is no longer any need for production tolerances even here, so that by eliminating these processing steps not only is the manufacturing outlay reduced, but at the same time the precision is increased. The inner surface of the precision bore 34 forms the surface 39 of the core 3, on which rest the movable elements constituted by armature 2, armature rod 21, armature body 20 and/or armature-rod guide 23.

FIG. 1 shows an arrangement in which the armature 2 is, where necessary, guided on two inner surfaces 39. In this case, the first inner surface 39 is situated in the upper core element 31 and cooperates with the armature body 20.

In the lower core element 30, there is provided the precision bore 34 which likewise forms an inner surface or surface 39 for the support of the armature rod 21.

The inner surface 39 in the upper core element 31 is of course also formed with an appropriate grade. The surface 39 may, for example, also be an appropriately treated surface, for example a milled or turned surface.

In the lower part 30 of the core 3 in this arrangement, only a relatively short section of the available length over which the rod 21 passes through the lower part 30 of the core is configured as a precision bore 34. The remaining regions 35 above and below the precision bore 34 may be rough-machined using a simpler tool and are set back with respect to the guiding surfaces of the precision bore 34.

In the embodiments according to FIGS. 1 to 3, the armature body 20 is made of a ferromagnetic material, and the armature rods 21 consist of a nonmagnetic bearing material. The armature rod 21 is designed to control appropriate elements, for example to close or open a valve, to release or block a flow of media, etc.

A further advantageous configuration of the invention is shown in FIG. 2. In this construction, the armature 2, which comprises armature body and armature rod, is supported in a cantilevered manner. This means that the support 4 is provided on only one side by the armature rod 21. The advantage of this version consists in the even more precise design of the support 4, which has a beneficial effect above all in relation to the magnetic transitions at the armature and which makes it possible above all to equip the armature rod 21 with a control edge 6 for pressure regulation, as is known in the case of sliding valves.

Connection of the magnetic coil 1 is in this case effected via the cabling 15.

Compared with the configuration according to FIGS. 1 or 3, here the armature rod 21 (FIG. 2) has an armature-rod guide 23, which in this case adjoins the armature rod directly below the armature body 20. The armature-rod guide 23 in this case has a diameter which is greater than the other regions of the armature rod 21. The armature-rod guide 23 may even have a diameter which is greater than the armature body 20. The armature-rod guide 23 in this case cooperates with the precision bore 34 in the upper part of the core lower part 30. There is the possibility of making the contact surfaces relatively short, thereby reducing the outlay in respect of the appropriately high-precision production.

Compared with known bearing gaps in the case of plastic composite bearings, which may be, for example, 100 $\mu$m and above, the bearing gap according to the invention lies in the $\mu$-range, with values of from below 10 $\mu$m to 30 $\mu$m being achieved. This results in a very long service life of the magnets and other advantages.

FIG. 3 depicts an electromagnet which is similar to the electromagnet according to FIG. 1. The essential difference is that the armature body 20 is arranged substantially not in the interior of the coil 1 (see FIG. 1) but below. The air gap once again is situated between the upper delimiting surface 22 and the lower delimiting surface 33 of the core upper part 31.

The different arrangement of the armature body 20, i.e. of the effective direction, according to FIGS. 1 or 3 makes it possible to realize falling or rising pressure-regulator characteristics.

Although the invention has been described in terms of specific embodiments which are set forth in considerable detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. An electromagnet comprising (a) a magnet coil, (b) an armature received within said magnet coil and movable longitudinally with respect to the axis of said coil, said armature including an armature body and an armature rod, said armature body consisting of a ferromagnetic material and said armature rod being made of a nonmagnetic material, (c) said armature rod provided on one side of said armature body, (d) a core serving for the guidance of a magnetic field generated by said magnet coil, and (e) a bore hole of said core for direct bearing of the armature rod on an inner surface of said bore hole of said core, a surface of said armature rod sliding on said inner surface of said bore hole of said core being harder than said inner surface of said core.

2. The electromagnet according to claim 1, wherein said armature rod is of a material selected from a group consisting of brass, bronze alloys and bearing metals.

3. The electromagnet according to claim 1, wherein said core comprises a plurality of core parts which are connected to one another, and wherein at least one of said core parts presents a surface that supports said armature or said armature rod.

4. The electromagnet according to claim 1, wherein two armature rods are provided on the armature body.

5. The electromagnet according to claim 1, wherein said armature or said armature rod acts on an element to be controlled.

6. The electromagnet according to claim 5, wherein said element is a valve.

7. The electromagnet according to claim 1 further comprising a guide having a diameter greater than a diameter of said armature body.

8. The electromagnet according to claim 1, wherein a portion of the armature has a diameter less than a diameter of the armature and greater than a diameter of the armature rod.

9. The electromagnet according to claim 1, which has a bearing gap between the core and the armature or the armature rod, the bearing gap is less than 30 $\mu$m.

* * * * *